United States Patent [19]

Oshikoshi et al.

[11] Patent Number: 4,768,811

[45] Date of Patent: Sep. 6, 1988

[54] CARD WITH PHOTOGRAPH

[75] Inventors: Yuji Oshikoshi, Tokyo; Schunichi Hosaka; Kiichiro Sakamoto, both of Kanagawa, all of Japan

[73] Assignee: Fuji Photo Film Co., Ltd., Kanagawa, Japan

[21] Appl. No.: 902,967

[22] Filed: Sep. 2, 1986

[30] Foreign Application Priority Data

| | | | |
|---|---|---|---|
| Aug. 30, 1985 | [JP] | Japan | 60-189695 |
| Sep. 9, 1985 | [JP] | Japan | 60-197769 |
| Sep. 9, 1985 | [JP] | Japan | 60-197770 |
| Sep. 9, 1985 | [JP] | Japan | 60-197771 |
| Oct. 3, 1985 | [JP] | Japan | 60-219114 |

[51] Int. Cl.[4] ..... B42D 15/00

[52] U.S. Cl. ..... 283/82; 283/903; 283/107

[58] Field of Search ..... 156/108, 252, 253, 277; 283/82, 903, 107, 109

[56] References Cited

U.S. PATENT DOCUMENTS

| | | | |
|---|---|---|---|
| 3,152,901 | 10/1964 | Johnson | 156/277 X |
| 3,711,353 | 1/1973 | Zimmer | 283/904 X |
| 3,949,501 | 4/1976 | Andrews et al. | 283/904 X |
| 4,456,639 | 6/1984 | Drower et al. | 283/107 X |
| 4,544,184 | 10/1985 | Freund et al. | 283/904 X |
| 4,560,426 | 12/1985 | Moraw et al. | 156/277 X |
| 4,589,687 | 5/1986 | Hannon | 283/904 X |
| 4,592,976 | 6/1986 | Whitehead | 283/904 X |
| 4,635,965 | 1/1987 | Vogt | 283/904 X |

*Primary Examiner*—Paul A. Bell

*Attorney, Agent, or Firm*—Young & Thompson

[57] ABSTRACT

A card with a photograph is of at least four-layer structure. The card includes: a display sheet made by printing a composite image of a portrait image and a character image such as a name on a photographic paper; a plastic frame sheet in which the display sheet is fitted; at least one plastic core sheet attached to the back surface of the frame sheet; a transparent plastic first cover sheet attached to the front surface of the frame sheet; a second cover sheet attached to the back surface of the core sheet; and an adhesive layer bonding the display sheet and the first cover sheet. The frame sheet, at least one core sheet, and the two cover sheets are made of a heat and pressure-weldable plastic such as a polyvinyl chloride resin. These four sheets are stacked one upon another, sandwiched between two ferro-type plates, and pressure-welded with heat, so that the four plastic sheets are pressure-welded with heat and the display sheet and the first cover sheet are heat-sealed. Lastly, the four sheets are punched out using a punching-out cutter to form a card with a narrow frame sheet remaining around the display sheet.

1 Claim, 7 Drawing Sheets

CARD WITH PHOTOGRAPH

BACKGROUND OF THE INVENTION

The present invention relates to a card with a photograph which is made by printing a portrait image and a data image on printing paper.

At present, there are widely used various cards such as identification (ID) cards, driving licenses, credit cards, bank cards, oil cards, commutation tickets, consultation tickets and so forth. Particularly, those cards which establish the identity of a card holder, for example, an ID card for a company employee, a driving license, etc., present a holder's photograph (a picture of the face) as well as the holder's personal information including name, date of birth and so forth.

Among conventional cards with a photograph, there is known a card of the type using a core sheet printed with the necessary headings. The core sheet is formed with an opening, and on it is entered personal information using a typewriter or the like. Thereafter, a small portrait (a picture of the face) is fitted in the opening. The core sheet is sandwiched between cover sheets for pressure-welding them with heat.

For a conventional driving license, first an application form filled in with typewritten personal information is set in a camera. Simultaneously with taking a portrait of the applicant by using a taking lens of the camera, the personal information is printed on a reversal color paper (0.23 mm in thickness) by using another lens of the camera. The reversal color paper with the portrait image and the character image printed as above, is sandwiched between two polyester sheets containing an ethylene copolymer as their main ingredient, each sheet being coated with an adhesive layer on one surface thereof.

Since a separately prepared portrait is fitted in the core sheet to make a card with a photograph after characters are typewritten thereon, it is troublesome and inefficient to make the card.

Since a reversal color paper is sandwiched between two polyester sheets to make a driving license, the license card is likely to be bent. Furthermore, since the portion where the color paper is located in the license card is thick and the periphery of the card is thin, it is inconvenient to hand it. Furthermore, since the edges of the reversal color paper are exposed, water may penetrate into the card from the exposed portion so that the color paper and the polyester sheets may be stripped off.

Although the reversal color paper and two polyester sheets of a conventional card with a photograph have been heat-sealed with an adhesive agent having an ethylene copolymer as its main ingredient, there is a problem that the reversal color paper and the polyester sheets are likely to be separated if the card is rubbed hard.

OBJECTS OF THE INVENTION

It is therefore a principal object of the present invention to provide a card with a photograph wherein it is easy to make a durable card having a flat surface as a whole.

It is another object of the present invention to provide a card with a photograph wherein there is no risk of water penetration and hence separation of the card.

SUMMARY OF THE INVENTION

To achieve the above and other objects, the card with a photograph of the present invention comprises: a display sheet made by printing a composite image of a character image such as person's name and a portrait image on a photographic paper; a plastic frame sheet in which the display sheet is fitted; at least one plastic core sheet attached to the back of the frame sheet; a first transparent plastic cover sheet attached to the front of the frame sheet; a second cover sheet attached to the back of the core sheet; and an adhesive layer for bonding the display sheet to the first cover sheet.

The display sheet is made in the following way:

First, one lays out a composite image of a portrait image and a character image of personal information such as name and age with the aid of a computer, the portrait image being produced for example by a TV camera and the character image being entered via a keyboard, the composite image being displayed on a CRT. Then the composite image is printed on a photographic paper such as a color photographic paper and is developed. It is preferable to use as a display sheet a photographic paper having a thickness of about 100 to 160 microns in order not to curl.

In order to prevent the display sheet sweeling and separating from the card, there is used a white or transparent plastic frame sheet formed with an opening in which the display sheet is mounted. It is desirable that this frame sheet be almost the same thickness as the display sheet, as the card will be flat. To the back side of the frame sheet, at least one white core sheet is attached in order to prevent the card from being bent. To opposite sides of the attached core and frame sheets, two transparent cover sheets are attached. In order to prevent the penetration of air between the display sheet and cover sheet in case they are rubbed hard and partially separated, these are attached to each other with an adhesive layer which is applied previously either to the printed surface of the display sheet or to a part of all of the surface of the cover sheet facing the display sheet.

The frame sheet, at least one core sheet, and the two cover sheets are made of plastic, for example polyvinyl chloride, which can be pressure-welded to each other with heat. At least these four sheets are stacked one upon another and are sandwiched between ferro-type plates for being pressed and heated so that the plastic sheets are pressure-welded with heat and that the display sheet and the first cover sheet are heat-sealed together. Finally the card is punched out in such a way that a narrow frame is left around the card. For mass production, a large-size frame sheet having a plurality of openings (e.g. four openings arranged in two rows) is used to mount a plurality of display sheets one in each opening. This frame sheet, a large-size core sheet and a cover sheet are stacked and pressure-welded with heat in the same way as in making a single card. Thus, a plurality of cards are punched out either at a time or one by one.

In order to simplify assembling these sheets and prevent these assembled sheets from changing in position, it is desirable to use a two-fold sheet, i.e., a first sheet composed of a core sheet area and a frame sheet area, and a second sheet composed of two cover sheet areas.

ADVANTAGEOUS EFFECTS OF THE INVENTION

According to the present invention, various advantages are offered. Namely, since the card is made by printing a composite image of a portrait image and a character image such as name on a photographic paper which is used as the display sheet, mounting the display sheet in the frame sheet, attaching at least one core sheet to the back of the frame sheet, and attaching the cover sheet to both sides of the attached core and frame sheets, the card can be manufactured efficiently. Moreover, not only the use of the frame sheet makes the entire surface of the card flat but also the use of at least one core sheet makes the card rigid and hard to bend.

In addition, since the display sheet is attached to the cover sheet with the aid of the adhesive layer, there is no penetration of air therebetween even when the card is rubbed hard and they are partially separated. Furthermore, it is possible to prevent a forgery in which only the portrait image is cut off from the card and is replaced with another portrait. Furthermore, since an embossing process not applicable to the conventional polyester sheet can be adopted, it is in this way also possible to prevent a forgery.

Furthermore, as the display sheet is smaller than the finished card and is surrounded by the frame sheet, there is no risk of water penetration to the display sheet.

DETAILED DESCRIPTION OF THE INVENTION

Figure 1:
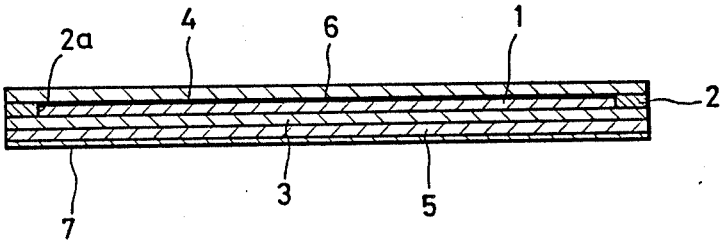
FIG. 1 is a cross sectional view showing a four-layer structure of the card with a photograph according to an embodiment of the present invention.
Figure 2:
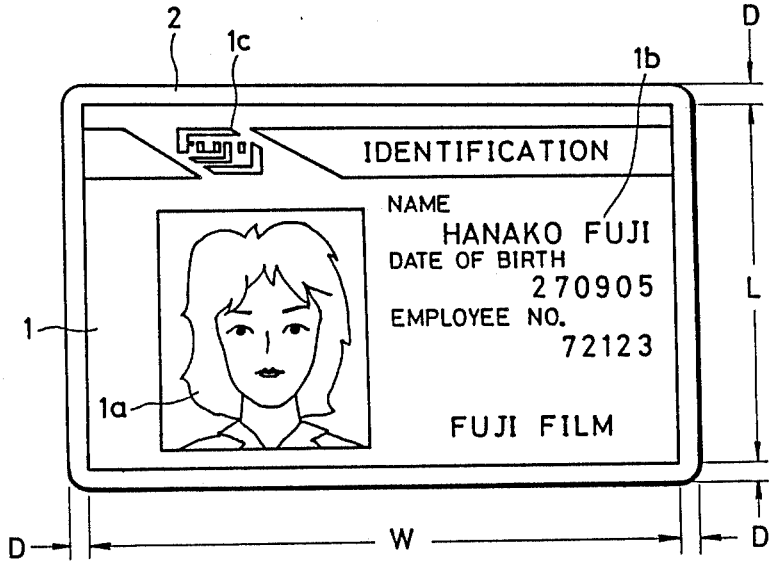
FIG. 2 is a plan view of the card with a photograph according to the present invention.

FIGS. 1 and 2 show a four-layer card with a photograph. As a display sheet 1, a thin color photographic paper of 100 to 160 microns thickness is used, and a human portrait image 1*a*, a character image 1*b* of personal information such as name, etc. and a design image 1*c* are printed on the printing surface of the color photographic paper. These images 1*a* to 1*c* are edited, that is, laid out with the aid of a computer to prepare a composite image thereof on a CRT used in printing. The composite image is printed on the color photographic paper by a three-color frame sequence exposure method. The color photographic paper is then processed to provide the display sheet 1.

The above-described display sheet 1 is mounted in an opening 2*a* of a frame sheet 2 which is made of a transparent or white plastic material such as a polyvinyl chloride resin. The display sheet 1 has a core sheet 3 pressure-welded to its back with heat. The core sheet 3, which is made of a white plastic such as a polyvinyl chloride resin, has at the back surface thereof printed statements such as instructions. The frame sheet 2 is covered with a first cover sheet 4 which is transparent and is pressure-welded with heat to the front surface thereof, and the core sheet 3 is covered with a second cover sheet 5 pressure-welded with heat to the back surface thereof. On the back of the second cover sheet 5 there is attached a magnetic strip 7. This magnetic strip 7 may be attached on the front of the first cover sheet 4.

In order to prevent separation while rubbing the card hard, the first cover sheet 4 and the display sheet 1 are securely bonded by means of a colorless transparent adhesive layer 6 which is previously applied either to the printed surface of the display sheet 1 or to the back surface of the first cover sheet 4 facing the printed surface. The adhesive layer 6 may be formed on the entire surface of the first cover sheet 4 or may be locally formed at the area facing the display sheet 1. Furthermore, the adhesive layer 6 may be formed on both sides of the display sheet 1.

Figure 3:
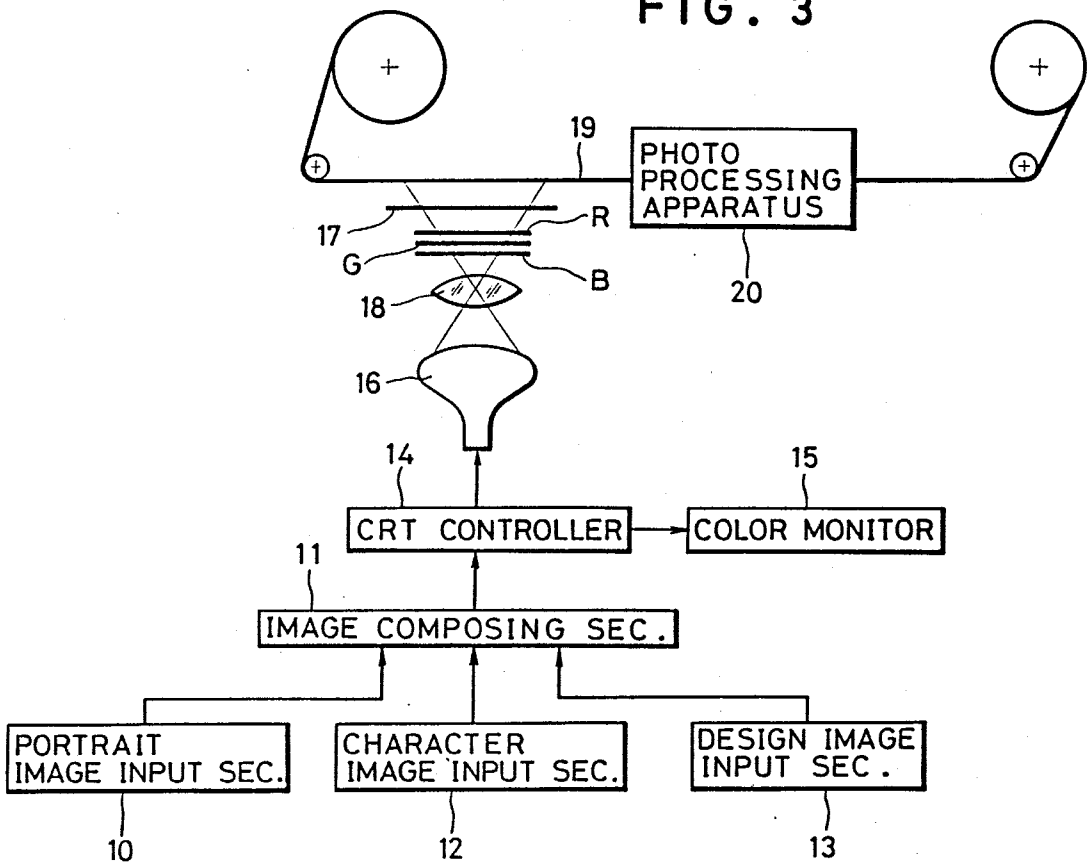
FIG. 3 is a block diagram illustrating a CRT composite image printing apparatus.

The preparation of the display sheet is as follows:

FIG. 3 shows a CRT composite image printing apparatus. A portrait image input section 10, which is an image reproducing device for reproducing a portrait image recorded for example on a magnetic recording medium, inputs a reproduced portrait image as data signals to an image composing section 11. The data of the portrait image are obtained either by directly picking up a person's upper half-figure with a TV camera, or indirectly picking up a photographed film with a TV camera on which film a portrait image has been recorded. The TV camera may be a video tape camera or a still video camera. The recording medium is a magnetic video tape for the video tape camera and a magnetic video floppy for the still video camera. If a video tape of $\frac{3}{4}$ inch width is used and ten seconds are required for recording one person, then 360 persons can be recorded on a 60-minute spool of tape. A video floppy disk can record 24 persons in frame recording.

A character image input section 12 is constructed as a console comprising a monitor CRT and a keyboard, the personal information such as name, the date of birth, and employee number, etc are inputted and edited by manipulation of the keyboard while watching images on the CRT. Instructions to read image data and start printing and so on are input via the keyboard. The personal information input through the keyboard is recorded on a recording medium, for example a floppy disk. Since there is almost no change of personal information, it suffices for the renewal of the card only to set the floppy disk storing the personal information in the CRT composite image printing device. As a result, the issuance of a new card is simplified.

In the design image input section 13 constructed, a digitizer is used to input computer graphic designs such as corporation marks and/or line drawings. The inputted data are stored in a floppy disk.

An image composing section 11 including a microcomputer reads portrait image data sequentially in the order of its recording in the portrait image input section 10, and character image data sequentially in the order of its inputting in the character image input section 12. These readout data are edited at proper positions so as too prepare an appropriate preliminary composite image which is then combined with a design image read from the design image input section 13 to prepare a complete composite image. The data of the complete composite image are sent to a controller 14 for a CRT 16.

The CRT controller 14, which is adapted to control a color monitor 15 and the black-and-white CRT 16, allows the composite image data to be sent only to the color monitor 15 before printing so as to display a positive image of the composite image on the screen of the color monitor 15. While printing, the CRT monitor 14 sends to the black-and-white CRT 16 the composite image data after having been processed so as to display the composite image in negative and causes a scanning beam to scan the screen in a direction opposite to a normal scanning direction, namely from the right to the left, so as to display the mirror image of the composite image.

After having confirmed the correspondence between the portrait image and the personal information on the color monitor 15, a print key of the console is operated. Then, the CRT controller 14 sequentially retrieves three primary color composite images of the composite image to display them on the black-and-white CRT 16. The black-and-white composite image on the black-and-white CRT 16 is focussed on a color photographic paper 19 through a lens 18 and is exposed while a shutter 17 is opened. In exposing the color photographic paper 19 to the three-primary-color composite image, three color filters, namely blue B, green G and red R are selectively inserted into the exposing optical path so as to change the black-and-white composite image displayed on the CRT 16 to the blue, green and red monochromatic images, respectively. Thus a color composite image is printed on the color paper 19 by a three color frame sequential exposure method. For the color photographic paper 19, it is desirable to use a thin color photographic paper of 10 to 160 microns thickness in order to prevent the card from being warped.

After one frame of the color composite image is printed on the color photographic paper 19, the paper is translated by one frame to print another color composite image thereon. The color printing paper 19 with a number of composite images printed thereon in sequence is sent to a photo-processing apparatus 20 well known in the art for developing, fixing and drying before being would up in a roll. If it is desired to emboss the color photographic paper 19 with a design such as a company mark, the embossing process is performed after drying.

Figure 4:
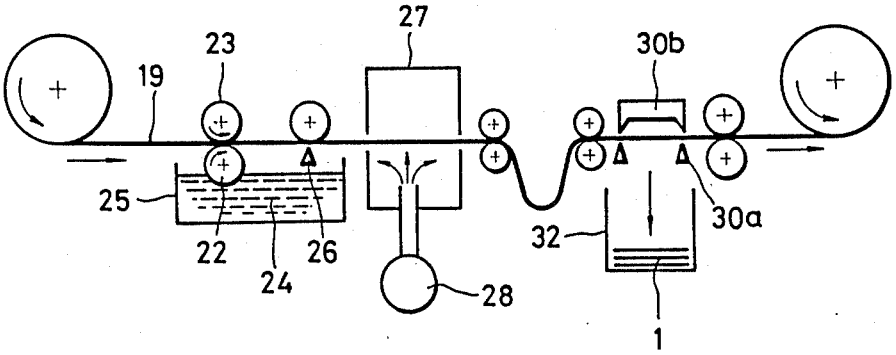
FIG. 4 is a schematic illustration showing a display sheet producing apparatus.

FIG. 4 shows an adhesive applicator for the application of an adhesive agent to the color photographic paper. The color photographic paper 19 which has a plurality of composite images printed thereon by the CRT composite image printing apparatus shown in FIG. 3 and which thereafter is would up in a roll, is coated with an adhesive agent 24 over the entire image-printed surface by a pair of adhesive application rolls 22 and 23. The adhesive agent 24 is contained in an adhesive pan 25. One of the rolls is partially immersed in the adhesive agent 24 to apply it to the color photographic paper 19.

The color photographic paper 19 with the adhesive agent 24 thus applied is passed through a dryer box 27 after the excess adhesive agent 24 is scrapped from the color photographic paper 19 by means of a squeegee roller 26 so as to form a uniform layer of the adhesive agent, for example, about 10 microns in thickness. In the dryer box 27 heated air is blown by a fan 28 to dry the adhesive agent 24 on the color photographic paper 19.

Figure 5:
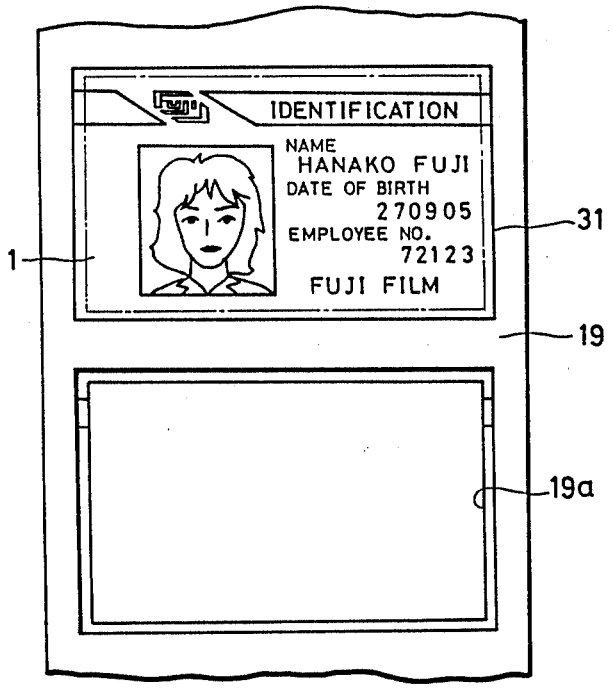
FIG. 5 is a plan view of a color photographic paper in which the area to be punched out is shown.

The color photographic paper 19 thus dried is sent to a punch-out position after passing through a slack loop. At the punch-out position there is disposed a punch-out cutter comprising a stationary knife **30*a* and a movable knife 30*b* adapted to punch out the color photographic paper 19 along a punch-out line 31 shown by a phantom line in FIG. 5 into display sheets 1 each of which has the portrait image, the character image such as name, etc. and the design image such as company mark, respectively printed in a proper positional arrangement thereon and which is stacked on a container 32. The color photographic paper 19 with a number of openings 19*a* formed therein as a result of punching out the display sheets 1** is wound up as waste paper in a roll.

The display sheet 1 thus produced and four pieces of the plastic sheets are laid one upon another as shown in FIG. 1 and are pressure-welded with heat between two chromium plated ferro-type plates to provide an integrated card with a photograph as shown in FIGS. 1 and 2.

Figure 6:
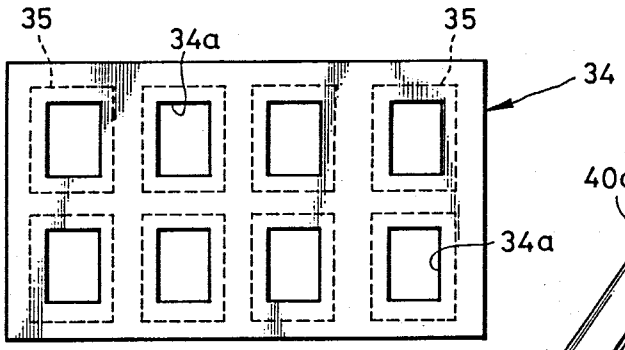
FIG. 6 is a plan view showing a large-size frame sheet.

For mass-producing the card with a photograph, as seen in FIG. 6, a large-size frame sheet 34 is used which has a number of openings **34*a* disposed side by side, for example in two rows and in four columns. A core sheet and cover sheet corresponding in size to that of the frame sheet 34 are used together with the frame sheet 34 to pressure-weld them with heat. Thereafter, a plurality of cards with photographs are made at a time by punching out along a punch-out line indicated by the broken line 35**. During the pressure-welding with heat, a set of combined sheets stacked up in multiple between the ferro-type plates is pressure-welded with heat for about 15 minutes under a pressure of 15 to 30 kg/cm$^2$ and a temperature of 140° to 160° C. Thereafter, the set of combined sheets is cooled with water for about 15 minutes.

Figure 7:
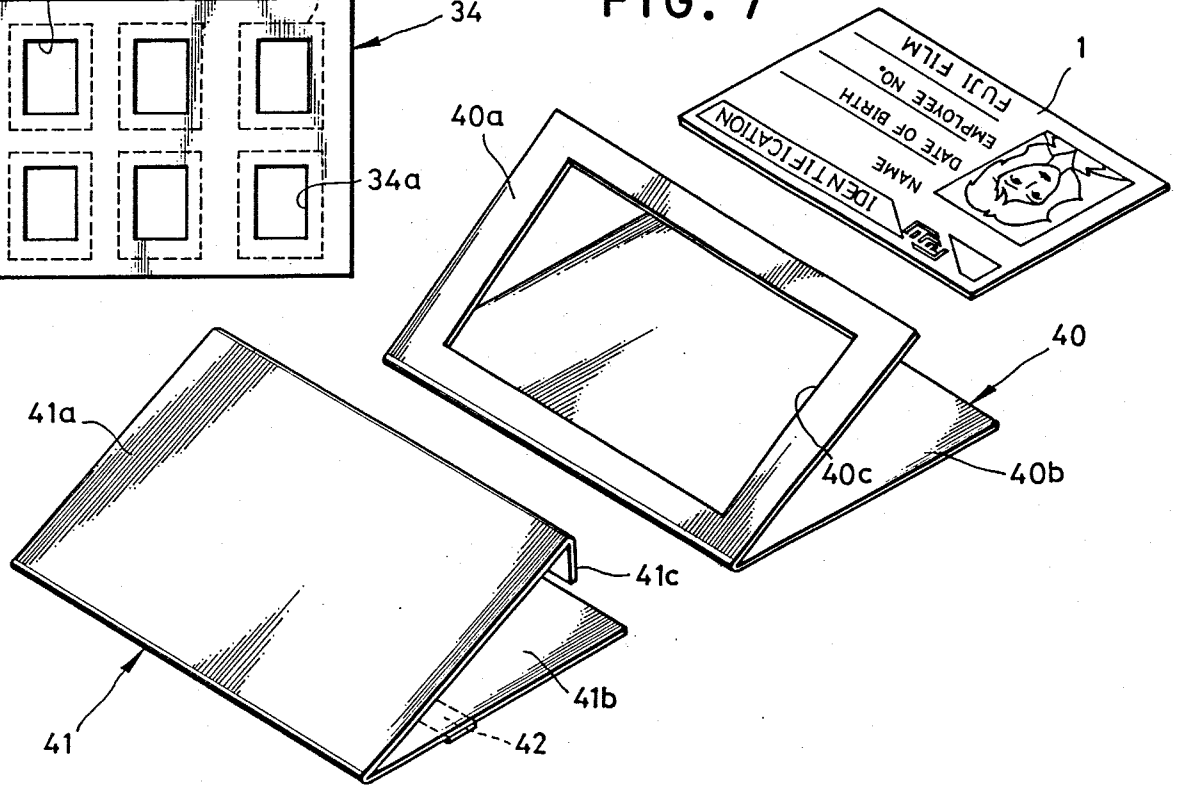
FIG. 7 is a perspective view showing the way in which the respective sheets including a two-fold sheet are assembled according to an embodiment of the present invention.
Figure 8:
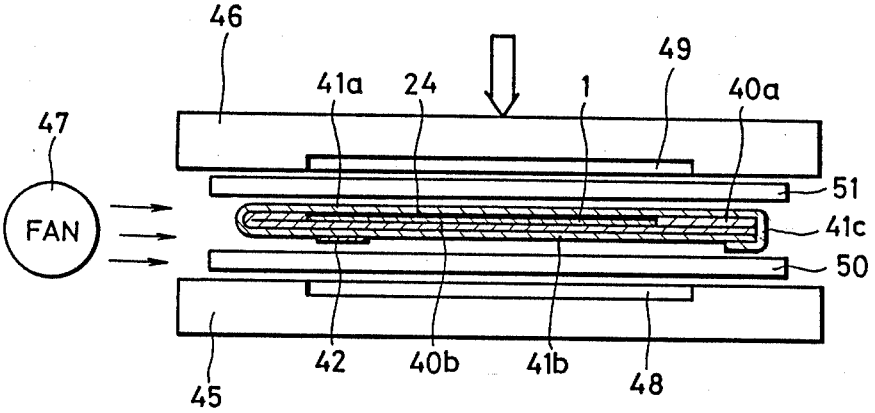
FIG. 8 is an illustration showing the step of heat and pressure-welding.
Figure 9:
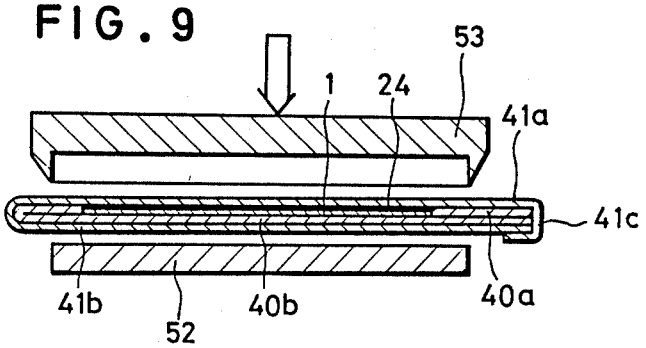
FIG. 9 is an illustration showing the step of punching-out.

Reference is next made to FIGS. 7 to 9 in order to explain the method of making the card with a photograph by using the two-fold first and second sheets. In FIG. 7, a display sheet 1 is made by the above-described steps to composite image printing, adhesive agent applying, and punching out in this order. The display sheet has a portrait image, a character image and a design image printed compositely thereon and is coated with an adhesive agent 24 (represented by numeral 6 in FIG. 1) having heat sealing properties.

A first sheet 40 is folded in two along a perforated line, one leaf serving as a frame sheet area 40*a* and the other as a core sheet area 40*b*. The frame sheet are 40*a* is formed with an opening 40*c*. The opening 40*c* is approximately the same size as the display sheet 1 so as to receive the same therein. The first sheet 40 is made of, for example, a plastic such as a white polyvinyl chloride resin. In fitting the display sheet 1 into the frame sheet area 40*c*, it is convenient to attach a double-faced adhesive tape to the back of the display sheet 1 for holding the same in place.

A transparent cover sheet 41 is folded in two along a perforated line, one leaf serving as a first cover sheet area 41*a* with a flap 41*c* folded along a perforated line and the other as a second cover sheet 41*b*. The first sheet 40 with the display sheet 1 fitted therein as described above is sandwiched between the leaves of the cover sheet 41. As the material of the transparent cover sheet 41, there is used a plastic, for example a transparent polyvinyl chloride resin, which is able to be pressure-welded to the first sheet 40 with heat. On the second cover sheet area 41*b* of the cover sheet 41, a magnetic strip 42 is attached at the front side thereof for magnetic recording. The flap 41*c* is provided so as to hold the first sheet 40 in place.

In this embodiment, there are used sheets of 0.15 mm thickness for the display sheet, of 0.2 mm thickness for the first sheet 40 and the cover sheet 41, and the adhesive agent 39 is of 0.01 mm thickness. The card having a four-layer structure of these sheets becomes 0.76 to 0.8 mm in total thickness.

The two-fold cover sheet 41 with the first sheet 40 sandwiched therein is integrated as a whole by the step of pressure-welding with heat as shown in FIG. 8. The heat and pressure-welding apparatus used for this step comprises a stationary press plate 45, a movable press plate 46 and a fan 47. Each of the press plates 45 and 46 has a heater 48 or 49 therein. For heat and pressure-welding, the sheet assembly is placed between chromium plated ferro-type plates 50 and 51 and put on the stationary press plate 45. Upon pressing a start button (not shown), the movable press plate 46 descends to press the sheet assembly sandwiched between the ferro-type plates 50 and 51, and the heaters 48 and 49 are powered to heat the sheet assembly, thereby pressure-welding the first and cover sheets 40 and 41 with heat. At this time, the adhesive agent 39 applied to the display sheet 1 melts to heat-seal the display sheet 1 to the first cover sheet area 41*a*.

The above-described heat and pressure-welding of the cover sheet 41 is effected, for example, at a pressure of 15 to 20 kg/cm$^2$ and a temperature of 140° to 150° C. for three to four minutes. After pressure-welding, the fan 47 is actuated, after the heaters 48 and 49 are turned off, so as to blow cooling air until the first and cover sheets 40 and 41 and the adhesive agent 39 cure. It is enough for curing to cool them for about three minutes. Then, the movable press plate 46 is raised to release the sheet assembly. As a result, the sheet assembly is reduced in thickness to about 0.76 to 0.8 mm or 0.72 to 0.76 mm in total. It is possible to pressure-weld a plurality of sheet assemblies with heat at a time in such a way that the sheet assemblies and ferro-type plates are stacked alternately and pressed from both sides in a press chamber whose interior is heated by a heater.

FIG. 9 shows the step of punching out a card. The punch-out apparatus for this step comprises a stationary knife 52 and a movable knife 53. Upon lowering the movable knife 53, a card with a photograph is punched out from the sheet assembly which has been integrated by the step of heat and pressure-welding, thereby providing the finished card as shown in FIGS. 1 and 2.

In this punching-out step, if the card is punched out inside the display sheet 1, the edge of the display sheet 1 is exposed externally and therefore, the card is likely to suffer penetration of moisture between the sheets, resulting in separation. For this reason, the card is punched out in such a way as to be surrounded by a frame of the integrated sheets 40 and 41 which is 5 mm in width. After this punching-out step, the card may be embossed with numerals such as employee number on the display sheet 1 by using an embossing machine available on the market.

Figure 10:
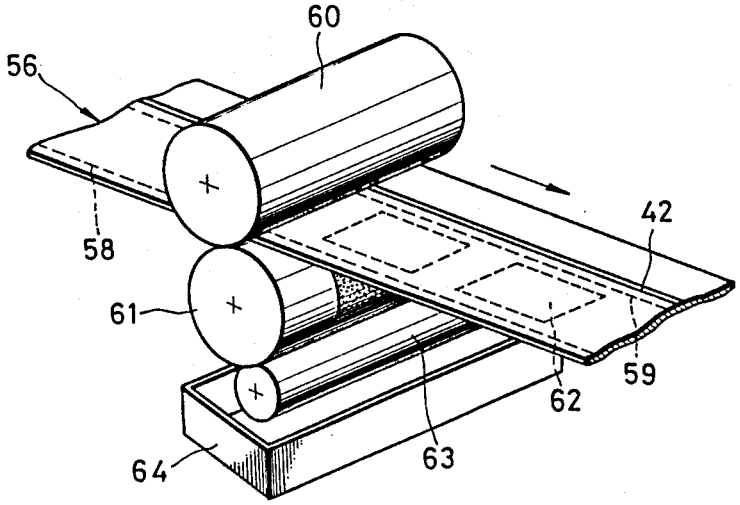
FIG. 10 is a schematic illustration showing an apparatus for applying an adhesive agent to cover sheet.

In the above embodiments, the adhesive layer is formed on the display sheet. However, the adhesive layer may be formed on the back surface of the first cover sheet. FIG. 10 shows an apparatus for applying an adhesive agent to the first cover sheet. A magnetic strip 42 is attached to an elongated sheet 56, and two perforated lines 58 and 59 are formed therein. The sheet 56, while passing between a pressure cylinder 60 and an impression cylinder 61, is coated with an adhesive agent 62 retained in a concave position of the impression cylinder 61. An adhesive application roller 63 is partially immersed in a container 64 containing an adhesive agent and applies the adhesive agent adhering to the outer periphery thereof, to the impression cylinder 61. The adhesive agent adhering to other than the concavity portion of the impression cylinder 61 is scraped off by a doctor blade (not shown) contacting the cylinder 61. The sheet 56 is subjected to a dry process (not shown) and thereafter cut along a one-dot-chain line 66 or 67 shown in FIG. 11 to obtain a cover sheet 41 as shown in FIG. 7.

Figure 12:
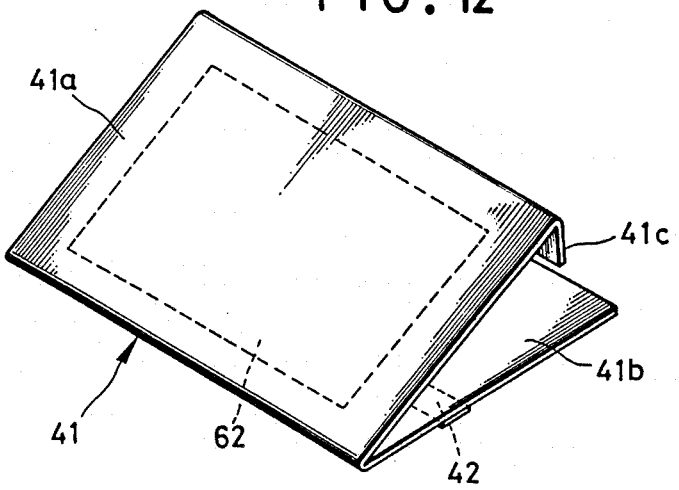
FIG. 12 is a perspective view showing the folded over sheet of FIG. 11.

As shown in FIG. 12, a cut-off transparent cover sheet 41 is folded into two leaves along a perforated line 59, one leaf being a first cover sheet area 41*a* coated with an adhesive layer 62 on the inner surface thereof and the other being a second cover sheet area 41*b*. The free edge of the first cover sheet area 41*a* is folded along a perforated line 58 to form a flap 41*c*. The cover sheet 41 thus configured is combined with other sheets as shown in FIG. 7 and is subjected to heat and pressure-welding and punching-out processes to make a card with a photograph.

Figure 11:
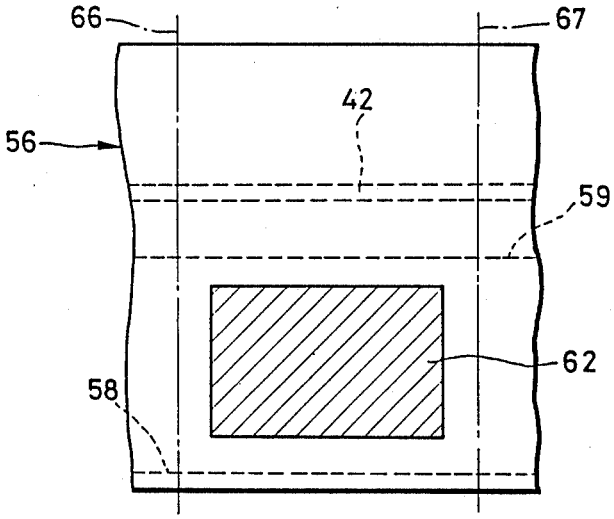
FIG. 11 is a plan view in which a cutting position of the cover sheet coated with an adhesive agent is shown.
Figure 13:
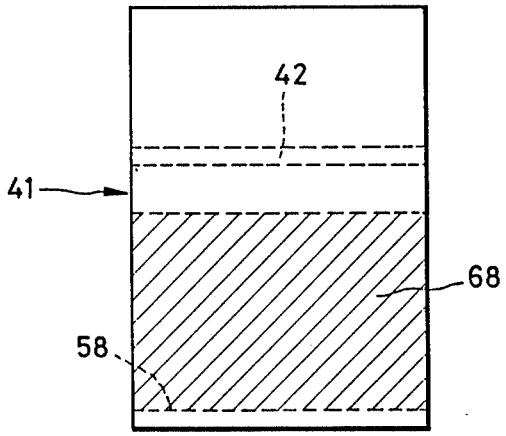
FIG. 13 is an exploded view of cover sheet with an adhesive agent coated on the entire area of one surface thereof according to an embodiment of the present invention.

In the embodiment shown in FIGS. 10 to 12, the adhesive agent is coated on the cover sheet 41 where it faces the display sheet 1. However, as shown by oblique lines 68 in FIG. 13, the adhesive agent may be coated on the entire surface of the first cover sheet leaf. Elements in FIG. 13 identical to those in FIG. 11 are represented using the same reference numerals.

Figure 14:
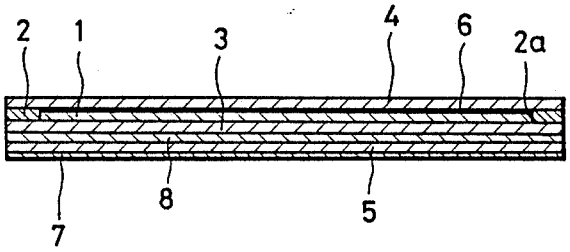
FIG. 14 is a cross sectional view showing the card with a photograph according to the present invention wherein two core sheets are used and a five-layer structure is produced.

In case a card with a photograph which is relatively rigid is desired, it is preferable to use two core sheets 3 and 8 as shown in FIG. 14. If a two-fold sheet shown in FIG. 7 is used, the core sheet 8 is inserted beneath the display sheet 1, and these sheets 1 and 8 are inserted between the leaves of the first sheet 40. Elements in FIG. 14 identical to those in FIG. 1 are represented using the same reference numerals.

The adhesive coated on the display sheet 1 or first cover sheet 4 are as set forth below. The properties required for such adhesives are high transparency to light after heat-sealing, less bubbling upon heat-sealing, no tack at ambient temperature and strong adhesive properties upon heating.

Adhesives having such properties can be prepared by adding at least one blended polymer to a base polymer. Examples of the base polymer are polyamide or chlorinated polypropylene. Examples of blended polymers are copolymers of the following formula:

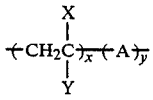

wherein

X is hydrogen, halogen, cyano or substituted or unsubstituted alkyl,

Y is hydrogen, halogen, cyano, substituted or unsubstituted alkyl, aryl,

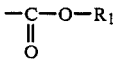

where $R_1$ is substituted or unsubstituted $C_{1-6}$ alkyl, or substituted or unsubstituted aryl,

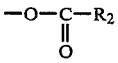

wherein $R_2$ is substituted or unsubstituted alkyl, or substituted or unsubstituted aryl, or

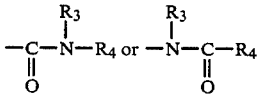

wherein $R_3$ and $R_4$ are hydrogen, substituted or unsubstituted alkyl, or substituted or unsubstituted aryl, and $R_3$ and $R_4$ may optionally be the same or different, A is a repeating monomeric unit derived from ethylenic unsaturated carboxylic acid, its salt or its anhydride, all of which are copolymerizable with ethylenic unsaturated monomers, and x and y are mol percentages of monomer to copolymer and have the relation $$x+y=100/0<x<60/40\leqq y<100$$

Substituents in the substituted alkyl and aryl are hydroxy, carboxyl, halogen and preferably chlorine, cyano, alkyl or aryl.

Embodiments of adhesives are illustrated in detail as follows:

Adhesives are required to bind polar polymer polyvinyl chloride and a display sheet 1 having a higher polar polymer containing hydrogen bonding in its surface layer by heat-sealing under pressure, and are required to have stiffness under mechanical force.

The ratio of mixing the base polymer and the blended polymer is a combination of 95–50 parts by weight of base polymer and 5–50 parts by weight of blended polymer.

Examples of the base polymer are:

(a) polyamide

The polyamide comprises a dimer as its base. Preferred examples are DPX-1163, -1175, -1300, -1358, DPX-1163N, DPX-925N, DPN-922D and Marcomelt 6238 (trade name: Henkel-Hakusui Co.).

(b) chlorinated polypropylene:

An example in Superchlone 822 (trade name: Sanyo Kokusaku Pulp Co.)

An example of the blended polymer is a copolymer of the formula (I) hereinbelow.

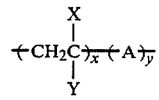

(I)

wherein X is hydrogen, halogen, cyano or substituted or unsubstituted alkyl,

Y is hydrogen, halogen, cyano, substituted or unsubstituted alkyl, aryl,

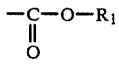

wherein $R_1$ is substituted or unsubstituted $C_{1-6}$ alkyl, or substituted or unsubstituted aryl,

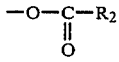

wherein $R_2$ is substituted or unsubstituted alkyl, or substituted or unsubstituted aryl, or

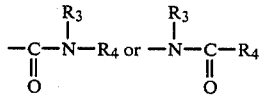

wherein $R_3$ and $R_4$ are hydrogen, substituted or unsubstituted alkyl, or substituted or unsubstituted aryl, and $R_3$ and $R_4$ may optionally be the same or different, A is a repeating monomeric unit derived from ethylenic unsaturated carboxylic acid, its salt or its anhydride, all of which are copolymerizable with ethylenic unsaturated monomers, and x and y are mol percentages of monomer to copolymer and have the relation $$x+y=100/0<x<60/40\leqq y<100.$$

Substituents in the substituted alkyl and aryl are hydroxy, carboxyl, halogen and preferably chlorine, cyano, alkyl or aryl.

Preferred examples of copolymer (I) hereinabove are as follows:

In the formula:

X is hydrogen or substituted or unsubstituted $C_{1-4}$,

Y is

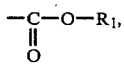

wherein $R_1$ is substituted or unsubstituted $C_{1-12}$ alkyl,

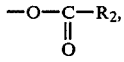

wherein $R_2$ is substituted or unsubstituted $C_{1-12}$ alkyl,

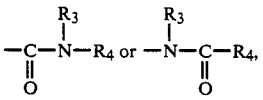

wherein $R_3$ and $R_4$ are hydrogen or substituted or unsubstituted $C_{1-12}$ alkyl, and $R_3$ and $R_4$ are the same or different. The ratio of monomer composition is preferably 60–99% for y, more preferably 70–90%.

Preferably Y is

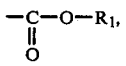

wherein $R_1$ is $C_{1-6}$ alkyl, preferably substituted or unsubstituted $C_{3-5}$ alkyl.

Examples of monomer of A is the general formula (II) hereinbelow or maleic anhydride.

An example thereof is a formula (II)

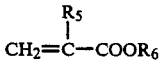

(II)

wherein $R_5$ is hydrogen or substituted or unsubstituted $C_{1-6}$ alkyl. Examples of substitutents are hydrogen, carboxyl, halogen and preferably chlorine, cyano and alkyl, and $R_6$ is—$R_4$—O—C—$R_7$—COOH, hydrogen or—$R_4$—O—$R_8$—COOH, in which $R_4$ and $R_7$ are the same or different and are alkylene, respectively, preferably $C_{2-4}$ and more preferably ethylene, and $R_8$ is alkylene or arylene, preferably phenylene. These groups can optionally be substituted by the substituents hereinbefore.

The monomer (II) can be used in the form of a salt in which the cation for such salt is alkali, alkaline earth or ammonium.

Examples of monomers in their free acid form are as follows:

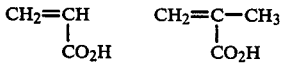

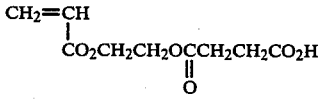

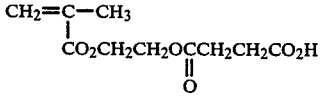

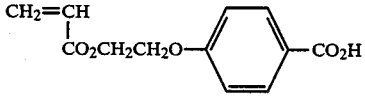

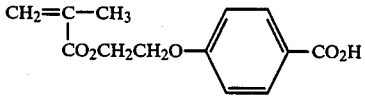

-continued

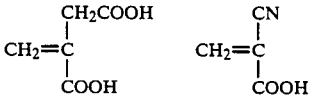

Among the above monomers, acrylic acid or methacrylic acid are preferred.

Examples of copolymers of the formula (I) hereinbefore are illustrated in the following, in which the ratio of copolymerization is expressed as mol percent:

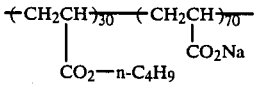

(a)

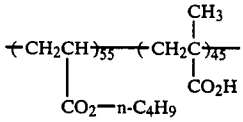

(b)

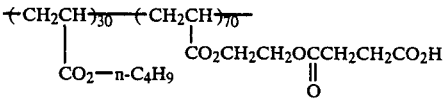

(c)

acrylate/butylmethacrylate copolymer:

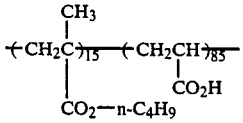

(d)

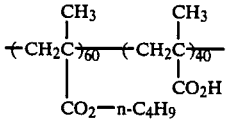

(e)

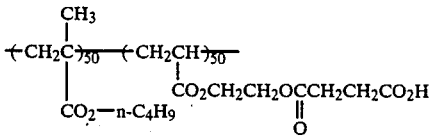

(f)

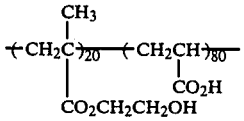

(g)

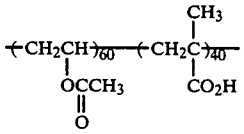

(h)

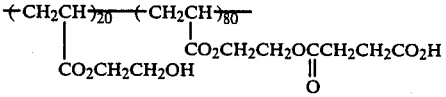

(i)

styrene/acrylate copolymer:

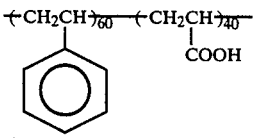

(j)

-continued

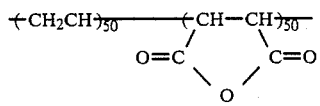

(k)

ethyl methacrylate/acrylate copolymer:

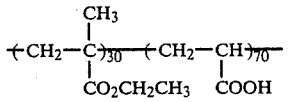

(l)

ethylacrylate/acrylate copolymer:

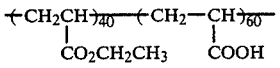

(m)

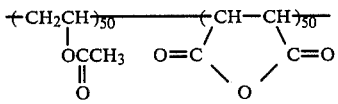

(n)

The following examples illustrate the present invention:

EXAMPLE 1

A human figure which was produced by a TV camera and recorded in video tape, literal statement which was put in through a keyboard and CG image which was put in through digitizer was composited to lay-out by a computer. A manifestation sheet, 0.15 mm in thickness, role type color printing paper, was used. Three kinds of mono-color images displayed on CRT successively were converted to single colored image of red, green and blue by using color filter, and printed the color image by means of successive three color exposure. The said color printing paper was developed and dried. Adhesives were spread over the printed surface on 0.01 mm in thickness. After drying the adhesives, plate was struck with 75.6 mm by 44 mm in dimensions.

Adhesives of the following composition was used. Percent is expressed by weight.

polyamide (DPX-1163N: Henckel-Hakusui Co.): 18%
acrylate/butylmethacrylate copolymer (85:15, molar ratio): 2%
toluene: 23%
n-propyl alcohol: 45%
ethanol: 8%
water: 4%

The frame sheet was 75.6 mm by 44 mm and 0.2 mm thick, of white polyvinyl chloride sheet, and the display sheet hereinbefore was set in the opening of said frame sheet. The lower face of the frame sheet was laid over a white core sheet of polyvinylchloride, 0.2 mm in thickness. The upper face of the above frame sheet was laid over the transparent first cover sheet of polyvinylchloride 0.2 mm in thickness, and beneath the core sheet hereinabove was laid a transparent second cover sheet of polyvinylchloride, 0.2 mm in thickness.

Ferro-plate (a stainless steel plate with chrome plating) was put on both sides of these four sheets and the sandwich was hot pressed by a pressing machine, at 15–20 kg/cm$^2$ and 140°–150° C. for 3–4 mins. After hot pressing, the assembly was cooled to ambient temperature and card was taken out together with the ferro-plate. The card was punched out to 85.6 mm by 54 mm, which left a 5 mm border about the display sheet, thereby to prepare the assembled card with a photograph.

The adhesion of the adhesives was complete.

EXAMPLE 2

In Example 1, the card preparation was repeated except that the following adhesives were used. The percentages are expressed by weight.

polyamide (DPX-1163N: Henckel-Hakusui Co.): 15%
acrylate/butylmethacrylate copolymer (85:15, molar ratio): 5%
toluene: 19%
n-propyl alcohol: 38%
ethanol: 20%
water: 3%

In this example, excellent adhesion was obtained, the same as in Example 1.

In these examples, color printing paper was used; however monochromatic printing paper can be used for printing monochromatic CRT composite images.

The above examples were given in the case of an identification card; however otehr cards with pictures, for example driving licenses can be prepared by the present invention.

What is claimed is:

1. In a card comprising:

a display sheet on which a portrait image and a character image are printed on a photographic paper;

a plastic frame sheet in which said display sheet is fitted;

at least one plastic core sheet attached to the back of said frame sheet;

at least one first transparent plastic cover sheet attached to the front of said frame sheet;

at least one second cover sheet attached to the back of said core sheet; and an adhesive layer bonding together said display sheet and said first cover sheet;

said core sheet and said frame sheet being made of a single two-fold sheet; and said first and second cover sheets being made of a single two-fold sheet.

* * * * *